US008093196B2

(12) United States Patent
Seebeck et al.

(10) Patent No.: US 8,093,196 B2
(45) Date of Patent: Jan. 10, 2012

(54) CLEANING FORMULATIONS FOR MACHINE DISHWASHING COMPRISING HYDROPHILICALLY MODIFIED POLYCARBOXYLATES

(75) Inventors: Tanja Seebeck, Bensheim (DE); Juergen Tropsch, Roemerberg (DE); Lars Kissau, Wachenheim (DE)

(73) Assignee: BASF SE, Ludwigshafen (DE)

( * ) Notice: Subject to any disclaimer, the term of this patent is extended or adjusted under 35 U.S.C. 154(b) by 0 days.

(21) Appl. No.: 12/783,726

(22) Filed: May 20, 2010

(65) Prior Publication Data

US 2010/0227787 A1 Sep. 9, 2010

Related U.S. Application Data

(63) Continuation of application No. 12/065,011, filed as application No. PCT/EP2006/065751 on Aug. 29, 2006.

(30) Foreign Application Priority Data

Aug. 31, 2005 (DE) ..... 10 2005 041 349

(51) Int. Cl.
*C11D 3/37* (2006.01)
*C11D 1/66* (2006.01)
*C11D 3/33* (2006.01)

(52) U.S. Cl. ..... 510/230; 510/220; 510/223; 510/229; 510/434; 510/476; 510/477

(58) Field of Classification Search ..... 510/220, 510/223, 229, 230, 434, 476, 477
See application file for complete search history.

(56) References Cited

U.S. PATENT DOCUMENTS

| | | | | |
|---|---|---|---|---|
| 5,618,782 | A | 4/1997 | Gopalkrishnan et al. | |
| 5,786,313 | A | 7/1998 | Schneider et al. | |
| 5,824,630 | A | 10/1998 | Christie et al. | |
| 5,998,346 | A * | 12/1999 | Welch et al. | 510/230 |
| 6,060,443 | A | 5/2000 | Cripe et al. | |
| 6,159,922 | A * | 12/2000 | Williams | 510/372 |
| 6,617,302 | B2 | 9/2003 | Ghatlia et al. | |
| 7,560,494 | B2 | 7/2009 | Steinbrenner et al. | |
| 7,728,063 | B2 | 6/2010 | Brodt et al. | |
| 2002/0198128 | A1 | 12/2002 | Perkins et al. | |
| 2003/0158064 | A1 | 8/2003 | Kessler et al. | |
| 2003/0158078 | A1 * | 8/2003 | Chang | 510/475 |
| 2003/0171246 | A1 | 9/2003 | Boeckh et al. | |
| 2004/0116319 | A1 | 6/2004 | Nitsch et al. | |
| 2005/0113271 | A1 | 5/2005 | Pegelow et al. | |
| 2005/0239680 | A1 | 10/2005 | Buchmeier et al. | |
| 2007/0004849 | A1 | 1/2007 | Siemensmeyer et al. | |
| 2007/0037934 | A1 | 2/2007 | Kluglein et al. | |
| 2007/0056900 | A1 | 3/2007 | Mathauer et al. | |
| 2007/0065391 | A1 | 3/2007 | Klumpe et al. | |
| 2007/0142258 | A1 | 6/2007 | Steinbrenner et al. | |
| 2007/0203050 | A1 | 8/2007 | Oetter et al. | |
| 2007/0238637 | A1 | 10/2007 | Michl et al. | |
| 2008/0188391 | A1 | 8/2008 | Seebeck et al. | |
| 2008/0207939 | A1 | 8/2008 | Tropsch et al. | |
| 2008/0248987 | A1 | 10/2008 | Seebeck et al. | |
| 2008/0255022 | A1 | 10/2008 | Seebeck et al. | |

FOREIGN PATENT DOCUMENTS

| | | |
|---|---|---|
| DE | 31 33 529 | 4/1982 |
| DE | 100 50 622 | 5/2002 |
| EP | 0 082 564 | 6/1983 |
| EP | 0 550 087 | 7/1993 |
| EP | 0 625 567 | 11/1994 |
| EP | 0 778 340 | 6/1997 |
| WO | WO 2005/090541 | 9/2005 |

OTHER PUBLICATIONS

U.S. Appl. No. 12/063,036, filed Feb. 6, 2008, Seebeck, et al.
U.S. Appl. No. 12/376,840, filed Feb. 9, 2009, Vandermeulen, et al.
U.S. Appl. No. 12/596,946, filed Oct. 21, 2009, Tropsch.
U.S. Appl. No. 12/594,109, filed Oct. 22, 2009, Tropsch.
U.S. Appl. No. 12/783,804, filed May 20, 2010, Seebeck, et al.

* cited by examiner

*Primary Examiner* — Brian P Mruk
(74) *Attorney, Agent, or Firm* — Oblon, Spivak, McClelland, Maier & Neustadt, L.L.P.

(57) ABSTRACT

A phosphate-free detergent formulation for machine dishwashing is provided. The formulation contains as main components: copolymers of a monoethylenically unsaturated monocarboxylic acid and/or of a salt thereof, and an alkoxylated, monoethylenically unsaturated monomer, wherein the copolymer has a mean molecular weight $M_w$ of from 30 000 to 500 000 g/mol and a K value of from 40 to 150, measured at pH 7 in 1% by weight aqueous solution at 25° C.; complexing agents; low-foaming nonionic surfactants; bleaches and, optionally, bleach activators; further builders; enzymes; and one or more further additives.

5 Claims, No Drawings

CLEANING FORMULATIONS FOR MACHINE DISHWASHING COMPRISING HYDROPHILICALLY MODIFIED POLYCARBOXYLATES

This application is a continuation of U.S. patent application Ser. No. 12/065,011, filed Feb. 27, 2008, now pending; which is a 371 application of PCT/EP2006/065751, filed Aug. 29, 2006, incorporated herein by reference.

Detergent formulations for a machine dishwashing comprising hydrophilically modified polycarboxylates.

DESCRIPTION

The invention relates to detergent formulations for machine dishwashing.

When dishware is cleaned in a machine dishwasher, the dishware, during the cleaning cycle, is freed from soil which is composed of a wide variety of food residues which also comprise fatty and oily constituents. The removed soil particles and components are circulated by pumping in the rinse water of the machine in the course of further cleaning. It has to be ensured that the removed soil particles are dispersed and emulsified effectively, so that they do not settle again on the ware.

Many formulations present on the market are phosphate-based. The phosphate used is ideal for the application, since it combines many useful properties which are required in machine dishwashing. One is that phosphate is capable of dispersing water hardness (i.e. insoluble salts of ions such as calcium and magnesium ions which cause water hardness). In fact, this task is also achieved by the ion exchanger of the machines. A large proportion of the products for machine dishwashing is, though, supplied nowadays in the form of what are known as 3-in-1 formulations in which the function of the ion exchanger is no longer needed. In this case, the phosphate, usually combined with phosphonates, takes over the softening of the water. In addition, the phosphate disperses the soil removed and thus prevents resettling of the soil on the ware.

In the case of cleaning compositions, many countries have made the transition for ecological reasons to fully phosphate-free systems. For the products for machine dishwashing too, there is discussion as to whether reversion to phosphate-free products is viable. However, the phosphate-free products which were still on the market in the mid-1990s no longer satisfy the current demands on the wash result. Nowadays, the consumer expects faultless, streak-, film- and drip-free dishes, preferably without the use of additional rinse aid or regenerating salt for the ion exchanger.

It is an object of the invention to provide phosphate-free detergent formulations for machine dishwashing. It is a particular object of the invention to provide such formulations which give rise to streak-, film- and drip-free dishes without use of additional rinse aid.

It has now been found that the replacement of phosphate can be achieved by the use of certain hydrophilically modified polycarboxylates in combination with certain complexing agents.

In this case, the complexing agents assume the task of complexing the ions which cause water hardness (calcium and magnesium ions) which are present in the rinse water or in the food residues. Polycarboxylates likewise have calcium binding capacity and are capable of dispersing sparingly soluble salts which form from water hardness and are additionally capable of dispersing the soil present in the wash liquor. The combination of complexing agents and polycarboxylates thus leads to particularly good scale inhibition during the machine dishwashing process.

The object is thus achieved by phosphate-free detergent formulations for machine dishwashing, comprising, as components:

a) from 1 to 20% by weight of copolymers of a1) from 50 to 99.5 mol % of a monoethylenically unsaturated monocarboxylic acid and/or of a salt thereof, a2) from 0.5 to 20 mol % of an alkoxylated, monoethylenically unsaturated monomer of the formula (I)

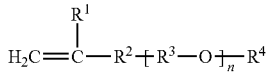

(I)

in which the variables are each defined as follows:

$R^1$ is hydrogen or methyl;

$R^2$ is $—(CH_2)_x—O—$, $—CH_2—NR^5—$, $—CH_2—O—CH_2—CR^6R^7—CH_2—O—$ or $—CONH—$;

$R^3$ are identical or different $C_2$-$C_4$-alkylene radicals which may be arranged in a block-like or random manner, the proportion of ethylene radicals being at least 50 mol %;

$R^4$ is hydrogen, $C_1$-$C_4$-alkyl, $—SO_3M$ or $—PO_3M_2$;

$R^5$ is hydrogen or $—CH_2—CR^1{=}CH_2$;

$R^6$ is $—O—[R^3—O]_n—R^4$, where the $—[R^3—O]_n—$ radicals may be different from the further $—[R^3—O]_n—$ radicals present in formula I;

$R^7$ is hydrogen or ethyl;

M is alkali metal or hydrogen;

n is from 4 to 250;

x is 0 or 1, a3) from 0 to 50 mol % of a monoethylenically unsaturated dicarboxylic acid, of an anhydride and/or of a salt thereof, a4) from 0 to 20 mol % of a further copolymerizable, monoethylenically unsaturated monomer, where the copolymer has a mean molecular weight $M_w$ of from 30 000 to 500 000 g/mol and a K value of from 40 to 150, (measured at pH 7 in 1% by weight aqueous solution at 25° C.), b) from 1 to 50% by weight, preferably from 5 to 40% by weight, of complexing agents selected from the group consisting of nitrilotriacetic acid, ethylenediaminetetraacetic acid, glycine-N,N-diacetic acid and their derivatives, glutamic acid N,N-diacetic acid, iminodiacetic acid, hydroxyiminodisuccinic acid, S,S-ethylenediaminedisuccinic acid and aspartic acid diacetic acid and also the salts of the aforementioned complexing agents, c) from 1 to 15% by weight, preferably from 1 to 10% by weight, of low-foaming nonionic surfactants, d) from 0 to 30% by weight, preferably from 0 to 20% by weight, of bleaches and, if appropriate, bleach activators, e) from 0 to 60% by weight, preferably from 0 to 40% by weight, of further builders, f) from 0 to 8% by weight, preferably from 0 to 5% by weight, of enzymes, g) from 0 to 50% by weight, preferably from 0.1 to 50% by weight, of one or more further additives such as anionic or zwitterionic surfactants, bleach catalysts, alkali carriers, corrosion inhibitors, defoamers, dyes, fragrances, fillers, organic solvents and water, the sum of components a) to g) adding up to 100% by weight.

The formulation may be processed as a tablet, powder, gel, capsule, extrudate or solution. They may either be formulations for household applications or for industrial applications.

The object is also achieved by the use of a combination of copolymers a) and complexing agents b) as builder systems in detergent formulations for machine dishwashing. The builder system assumes the task of complexing the ions which cause water hardness (calcium and magnesium ions), which are present in the rinse water or in the food residues.

The object is also achieved by the use of a combination of copolymers a) and complexing agents b) as a scale-inhibiting additive in detergent formulations for machine dishwashing.

The copolymers a) used in accordance with the invention comprise, as a copolymerized monomer a1), a monoethylenically unsaturated monocarboxylic acid, preferably a $C_3$-$C_6$-monocarboxylic acid, and/or a water-soluble salt, especially an alkali metal salt, such as a potassium salt and in particular sodium salt, or ammonium salt of this acid.

Examples of suitable monomers a1) include: acrylic acid, methacrylic acid, crotonic acid and vinylacetic acid. It will be appreciated that mixtures of these acids may also be used.

A particularly preferred monomer a1) is acrylic acid.

The copolymers a) used in accordance with the invention comprise from 50 to 99.5 mol % of monomer a1). When the copolymers are composed only of monomers a1) and a2), the content of monomer a1) is generally from 80 to 99.5 mol %, preferably from 90 to 98 mol %. Terpolymers composed of monomers a1), a2) and a3) comprise generally from 60 to 98 mol %, preferably from 70 to 95 mol %, of monomer a1).

As a copolymerized monomer a2), the copolymers used in accordance with the invention comprise an alkethoxylated monoethylenically unsaturated monomer of the formula (I)

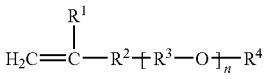

(I)

in which the variables are defined as follows:

$R^1$ is hydrogen or methyl, preferably hydrogen;

$R^2$ is —$(CH_2)_x$—O—, —$CH_2$—$NR^5$—, —$CH_2$—O—$CH_2$—$CR^6R^7$—$CH_2$—O— or —CONH—, preferably —$(CH_2)_x$—O—, —$CH_2$—$NR^5$— or —$CH_2$—O—$CH_2$—$CR^6R^7$—$CH_2$—O— and more preferably —$(CH_2)_x$—O— or —$CH_2$—O—$CH_2$—$CR^6R^7$—$CH_2$—O—;

$R^3$ are identical or different $C_2$-$C_4$-alkylene radicals which may be arranged in a block-like or random manner, the proportion of ethylene radicals being at least 50 mol %, preferably at least 75 mol % and more preferably 100 mol %;

$R^4$ is hydrogen, $C_1$-$C_4$-alkyl, —$SO_3M$ or —$PO_3M_2$;

$R^5$ is hydrogen or —$CH_2$—$CR^1$=$CH_2$;

$R^6$ is —O—$[R^3$—$O]_n$—$R^4$, where the —$[R^3$—$O]_n$— radicals may be different from the further —$[R^3$—$O]_n$— radicals present in formula I and the preferences stated for $R^3$ apply;

$R^7$ is hydrogen or ethyl;

M is alkali metal, preferably sodium or potassium, or hydrogen;

n is from 4 to 250, preferably from 5 to 200 and more preferably from 10 to 100;

x is 0 or 1.

Specific examples of particularly suitable monomers a2) include the alkoxylation products of the following unsaturated monomers: (meth)allyl alcohol, (meth)allylamines, diallylamines, glycerol monoallyl ether, trimethylolpropane monoallyl ether, vinyl ether, vinylamides and vinylamines.

It will be appreciated that it is also possible to use mixtures of the monomers a2).

Particular preference is given to monomers a2) which are based on allyl alcohol, glycerol monoallyl ether, trimethylolpropane monoallyl ether and diallylamine.

Very particularly preferred monomers a2) are ethoxylated allyl alcohols which comprise especially from 5 to 20, in particular from 10 to 100 mol of EO/mol of allyl alcohol.

The monomers a2) may be prepared by commonly known standard processes of organic chemistry, for example by amidation and transamidation of suitable (meth)acrylic acids, by alkoxylation of allyl alcohol, glycerol monoallyl ether, trimethylolpropane monoallyl ether; by etherification of allyl halides with poly-$C_2$-$C_4$-alkylene oxides and vinylation of polyalkylene oxides with OH or NH end group with acetylene.

Should the copolymers used in accordance with the invention have —$SO_3M$ or —$PO_3M_2$ end groups, they may be introduced by sulfating or phosphating the monomers (B) or else the copolymers themselves, for example with chlorosulfonic acid or polyphosphoric acid.

The copolymers used in accordance with the invention comprise from 0.5 to 20 mol % of the monomer a2). When the copolymers are formed only from monomers a1) and a2), the content of monomer a1) is generally from 0.5 to 20 mol %, preferably from 1 to 10 mol %. Terpolymers composed of monomers a1), a2) and a3) comprise generally from 1 to 15 mol %, preferably from 1 to 10 mol %, of monomer a2).

The copolymers used in accordance with the invention may comprise, as a copolymerized monomer a3) a monoethylenically unsaturated dicarboxylic acid, preferably a $C_4$-$C_8$ dicarboxylic acid. It will be appreciated that, instead of the free acid, it is also possible to use its anhydride and/or one of its water-soluble salts, in particular an alkali metal salt such as a potassium salt and in particular sodium salt, or ammonium salt.

Specific examples of suitable monomers a3) include: maleic acid, fumaric acid, methylenemalonic acid, citraconic acid and itaconic acid. It will be appreciated that it is also possible to use mixtures of these acids.

A particularly preferred monomer a3) is maleic acid.

When the monomer a3) is present in the copolymers used in accordance with the invention, its content is generally from 1 to 30 mol %, preferably from 5 to 30 mol %.

The copolymers used in accordance with the invention are preferably formed only from monomers a1) and a2) or from monomers a1), a2) and a3).

However, they may also comprise a further monoethylenically unsaturated monomer a4) different from the monomers a1) to a3) but copolymerizable with these monomers.

Examples of suitable monomers a4) are:

esters of monoethylenically unsaturated $C_3$-$C_5$-carboxylic acids, especially (meth)acrylic esters, such as methyl, ethyl, propyl, hydroxypropyl, n-butyl, isobutyl, 2-ethylhexyl, decyl, lauryl, isobornyl, cetyl, palmityl and stearyl (meth)acrylate;

(meth)acrylamides such as (meth)acrylamide, N—($C_1$-$C_{12}$-alkyl)- and N,N-di($C_1$-$C_4$-alkyl)(meth)acrylamides such as N-methyl-, N,N-dimethyl-, N-ethyl-, N-propyl-, N-tert-butyl-, N-tert-octyl- and N-undecyl(meth)acrylamide;

vinyl esters of $C_2$-$C_{30}$ carboxylic acids, especially $C_2$-$C_{14}$ carboxylic acids, such as vinyl acetate, vinyl propionate, vinyl butyrate, vinyl 2-ethylhexanoate and vinyl laurate;

N-vinylamides and N-vinyllactams such as N-vinylformamide, N-vinyl-N-methylformamide, N-vinylacetamide, N-vinyl-N-methylacetamide, N-vinyl-pyrrolidone, N-vinylpiperidone and N-vinylcaprolactam;

vinylsulfonic acid and vinylphosphonic acid;

vinylaromatics such as styrene and substituted styrenes, for example alkylstyrenes such as methylstyrene and ethylstyrene.

When monomers a4) are present in the copolymers used in accordance with the invention, their content is generally from 1 to 20 mol %, preferably from 1 to 10 mol %. When the monomers a4) used are hydrophobic monomers, their content should be selected such that the copolymer retains its hydrophilic character overall.

The copolymers used in accordance with the invention have a mean molecular weight $M_w$ of from 30 000 to 500 000 g/mol, preferably from 50 000 to 300 000 g/mol (determined by gel permeation chromatography at room temperature with aqueous eluent).

Their K values are accordingly from 40 to 150, preferably from 50 to 125 (measured at pH 7 in 1% by weight aqueous solution at 25° C.; according to H. Fikentscher, Cellulose-Chemie, vol. 13, p. 58-64 and 71-74 (1932)).

The copolymers used in accordance with the invention may be obtained by the known free-radical polymerization processes. In addition to polymerization in bulk, mention should be made in particular of solution and emulsion polymerization, preference being given to solution polymerization.

The polymerization is preferably carried out in water as a solvent. However, it may also be undertaken in alcoholic solvents, especially in $C_1$-$C_4$ alcohols such as methanol, ethanol and isopropanol, or in mixtures of these solvents with water.

Suitable polymerization initiators are compounds which decompose both thermally and photochemically (photoinitiators) to form free radicals.

Among the thermally activable polymerization initiators, preference is given to initiators with a decomposition temperature in the range from 20 to 180° C., in particular from 50 to 120° C. Examples of suitable thermal initiators are inorganic peroxo compounds and azo compounds. These initiators may be used in combination with reducing compounds as initiator/regulator systems. Examples of suitable photoinitiators are benzophenone, acetophenone, benzoin ether, benzyldialkyl ketones and derivatives thereof.

Preference is given to using thermal initiators, preference being given to inorganic peroxo compounds, especially hydrogen peroxide and in particular sodium peroxodisulfate (sodium persulfate).

If desired, it is also possible to use polymerization regulators. Suitable regulators are the compounds known to those skilled in the art, for example sulfur compounds such as mercaptoethanol, 2-ethylhexyl thioglycolate, thioglycolic acid and dodecyl mercaptan.

When polymerization regulators are used, their use amount is generally from 0.1 to 15% by weight, preferably from 0.1 to 5% by weight and more preferably from 0.1 to 2.5% by weight, based on the sum of the monomers.

The polymerization temperature is generally from 30 to 200° C., preferably from 50 to 150° C. and more preferably from 80 to 130° C.

The polymerization is preferably undertaken under protective gas such as nitrogen or argon and can be carried out under atmospheric pressure, but is preferably undertaken in a closed system under the autogenous pressure which develops.

The copolymers used in accordance with the invention are typically obtained in the form of a polymer solution which has a solids content of from 10 to 70% by weight, preferably from 25 to 60% by weight.

As component b), the inventive detergent formulations comprise one or more complexing agents which are selected from the group consisting of nitrilotriacetic acid, ethylenediaminetetraacetic acid, glycine-N,N-diacetic acid derivatives, glutamic acid N,N-diacetic acid, iminodisuccinic acid, hydroxyiminodisuccinic acid, S,S-ethylene-diaminedisuccinic acid and aspartic acid diacetic acid, and also their salts. Preferred complexing agents b) are methylglycinediacetic acid and/or salts thereof.

Suitable glycine-N,N-diacetic acid derivatives are compounds of the general formula

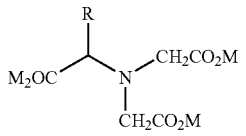

(I)

in which

R is $C_1$- to $C_{12}$-alkyl and

M is alkali metal.

In the compounds of the general formula, M is an alkali metal, preferably sodium or potassium, more preferably sodium.

R is a $C_{1-12}$-alkyl radical, preferably a $C_{1-6}$-alkyl radical, more preferably a methyl or ethyl radical. As component (a) particular preference is given to using an alkali metal salt of methylglycinediacetic acid (MGDA). Very particular preference is given to using the trisodium salt of methylglycinediacetic acid.

The preparation of such glycine-N,N-diacetic acid derivatives is known, cf. EP-A-0 845 456 and literature cited therein.

As component c), the inventive detergent formulations comprise low-foaming or nonfoaming nonionic surfactants. These are generally present in proportions of from 1 to 15% by weight, preferably from 1 to 10% by weight.

Suitable nonionic surfactants include the surfactants of the general formula (II)

$$R^1—(OCH_2CHR^2)_p—(OCH_2CHR^3)_m—OR^4 \quad (II)$$

where $R^1$ is a linear or branched alkyl radical having from 6 to 24 carbon atoms, $R^2$ and $R^3$ are each independently hydrogen or a linear or branched alkyl radical having 1-16 carbon atoms, where $R^2 \neq R^3$ and $R^4$ is a linear or branched alkyl radical having 1 to 8 carbon atoms, p and m are each independently from 0 to 300. Preferably, p=1-50 and m=0-30.

The surfactants of the formula (II) may be either random copolymers or block copolymers having one or more blocks.

In addition, it is possible to use di- and multiblock copolymers composed of ethylene oxide and propylene oxide, which are commercially available, for example, under the name Pluronic® (BASF Aktiengesellschaft) or Tetronic® (BASF Corporation). In addition, it is possible to use reaction products of sorbitan esters with ethylene oxide and/or propylene oxide. Likewise suitable are amine oxides or alkylglycosides. An overview of suitable nonionic surfactants is given by EP-A 851 023 and by DE-A 198 19 187.

The formulations may further comprise anionic, cationic, amphoteric or zwitterionic surfactants, preferably in a blend with nonionic surfactants. Suitable anionic and zwitterionic surfactants are likewise specified in EP-A 851 023 and DE-A 198 19 187. Suitable cationic surfactants are, for example, $C_8$-$C_{16}$-dialkyldimethylammonium halides, dialkoxydimethylammonium halides or imidazolinium salts with a long-chain alkyl radical. Suitable amphoteric surfactants are, for example, derivatives of secondary or tertiary amines such as $C_8$-$C_{18}$-alkyl betaines or $C_6$-$C_{15}$-alkyl sulfobetaines, or amine oxides such as alkyldimethylamine oxides.

As component d), the inventive detergent formulations may comprise bleaches and, if appropriate, bleach activators.

Bleaches subdivide into oxygen bleaches and chlorine bleaches. Oxygen bleaches which find use are alkali metal perborates and hydrates thereof, and also alkali metal percarbonates. Preferred bleaches in this context are sodium perborate in the form of a mono- or tetrahydrate, sodium percarbonate or the hydrates of sodium percarbonate.

Oxygen bleaches which can likewise be used are persulfates and hydrogen peroxide.

Typical oxygen bleaches are also organic peracids, for example perbenzoic acid, peroxy-alpha-naphthoic acid, peroxylauric acid, peroxystearic acid, phthalimidoperoxy-caproic acid, 1,12-diperoxydodecanedioic acid, 1,9-diperoxyazelaic acid, diperoxo-isophthalic acid or 2-decyldiperoxybutane-1,4-dioic acid.

In addition, the following oxygen bleaches may also find use in the detergent formulation:

Cationic peroxy acids which are described in U.S. Pat. No. 5,422,028, U.S. Pat. No. 5,294,362 and U.S. Pat. No. 5,292,447; sulfonylperoxy acids which are described in U.S. Pat. No. 5,039,447.

Oxygen bleaches are used in amounts of generally from 0.5 to 30% by weight, preferably of from 1 to 20% by weight, more preferably of from 3 to 15% by weight, based on the overall detergent formulation.

Chlorine bleaches and the combination of chlorine bleaches with peroxidic bleaches may likewise be used. Known chlorine bleaches are, for example, 1,3-dichloro-5,5-dimethylhydantoin, N-chlorosulfamide, chloramine T, dichloramine T, chloramine B, N,N'-dichlorobenzoylurea, N,N'-dichloro-p-toluenesulfonamide or trichloroethylamine. Preferred chlorine bleaches are sodium hypochlorite, calcium hypochlorite, potassium hypochlorite, magnesium hypochlorite, potassium dichloroisocyanurate or sodium dichloroisocyanurate.

Chlorine bleaches are used in amounts of generally from 0.1 to 20% by weight, preferably of from 0.2 to 10% by weight, more preferably of from 0.3 to 8% by weight, based on the overall detergent formulation.

In addition, small amounts of bleach stabilizers, for example phosphonates, borates, metaborates, metasilicates or magnesium salts, may be added.

Bleach activators are compounds which, under perhydrolysis conditions, give rise to aliphatic peroxocarboxylic acids having preferably from 1 to 10 carbon atoms, in particular from 2 to 4 carbon atoms, and/or substituted perbenzoic acid. Suitable compounds comprise one or more N- or O-acyl groups and/or optionally substituted benzoyl groups, for example substances from the class of the anhydrides, esters, imides, acylated imidazoles or oximes. Examples are tetraacetylethylenediamine (TAED), tetraacetylmethylenediamine (TAMD), tetraacetylglycoluril (TAGU), tetra-acetylhexylenediamine (TAHD), N-acylimides, for example N-nonanoylsuccinimide (NOSI), acylated phenolsulfonates, for example n-nonanoyl- or isononanoyloxy-benzenesulfonates (n- and iso-NOBS), pentaacetylglucose (PAG), 1,5-diacetyl-2,2-dioxohexahydro-1,3,5-triazine (DADHT) or isatoic anhydride (USA). Likewise suitable as bleach activators are nitrile quats, for example, N-methylmorpholinium-acetonitrile salts (MMA salts) or trimethylammonium-acetonitrile salts (TMAQ salts).

Preferred bleach activators are from the group consisting of polyacylated alkylenediamines, more preferably TAED, N-acylimides, more preferably NOSI and acylated phenolsulfonates, more preferably n- or iso-NOBS, MMA and TMAQ.

In addition, the following substances may find use as bleach activators in the detergent formulation:

carboxylic acids, for example phthalic anhydride; acylated polyhydric alcohols, for example triacetin, ethylene glycol diacetate or 2,5-diacetoxy-2,5-dihydrofuran; the enol esters known from DE-A 196 16 693 and DE-A 196 16 767, and also acylated sorbitol and mannitol and the mixtures thereof described in EP-A 525 239; acylated sugar derivatives, in particular pentaacetylglucose (PAG), pentaacetylfructose, tetraacetyl-xylose and octaacetyllactose, and also acylated, optionally N-alkylated, glucamine and gluconolactone, and/or N-acylated lactams, for example N-benzoylcaprolactam, which are known from the documents WO 94/27 970, WO 94/28 102, WO 94/28 103, WO 95/00 626, WO 95/14 759 and WO 95/17 498.

The hydrophilically substituted acylacetals listed in DE-A 196 16 769 and the acyllactams described in DE-A 196 16 770 and WO 95/14 075 may be used, just like the combinations, known from DE-A 44 43 177, of conventional bleach activators.

Bleach activators are used in amounts of generally from 0.1 to 10% by weight, preferably of from 1 to 9% by weight, more preferably of from 1.5 to 8% by weight, based on the overall detergent formulation.

As component e), the inventive detergent formulations may comprise further builders. It is possible to use water-soluble and water-insoluble builders, whose main task consists in binding calcium and magnesium.

The further builders used may be:

low molecular weight carboxylic acids and salts thereof, such as alkali metal citrates, in particular anhydrous trisodium citrate or trisodium citrate dihydrate, alkali metal succinates, alkali metal malonates, fatty acid sulfonates, oxydisuccinate, alkyl or alkenyl disuccinates, gluconic acids, oxadiacetates, carboxymethyloxysuccinates, tartrate monosuccinate, tartrate disuccinate, tartrate monoacetate, tartrate diacetate, α-hydroxypropionic acid;

oxidized starches, oxidized polysaccharides;

homo- and copolymeric polycarboxylic acids and salts thereof, such as polyacrylic acid, polymethacrylic acid, copolymers of maleic acid and acrylic acid;

graft polymers of monoethylenically unsaturated mono- and/or dicarboxylic acids on monosaccharides, oligosaccharides, polysaccharides or polyaspartic acid; further aminopolycarboxylates and polyaspartic acid;

phosphonates such as 2-phosphono-1,2,4-butanetricarboxylic acid, aminotri-(methylenephosphonic acid), 1-hydroxyethylene(1,1-diphosphonic acid), ethylene-diaminetetramethylenephosphonic acid, hexamethylenediaminetetramethylene-phosphonic acid or diethylenetriaminepentamethylenephosphonic acid;

silicates such as sodium disilicate and sodium metasilicate;

water-insoluble builders such as zeolites and crystalline sheet silicates.

As component f), the inventive detergent formulations comprise one or more enzymes. It is possible to add to the detergent between 0 and 8% by weight of enzymes based on the overall formulation in order to increase the performance of the detergent or to ensure the cleaning performance in the same quality under milder conditions. The enzymes used most frequently include lipases, amylases, cellulases and proteases. In addition, it is also possible, for example, to use esterases, pectinases, lactases and peroxidases.

The inventive detergents may additionally comprise, as component g), further additives such as anionic or zwitterionic surfactants, bleach catalysts, alkali carriers, corrosion inhibitors, defoamers, dyes, fragrances, fillers, organic solvents and water.

In addition to or instead of the above-listed conventional bleach activators it is also possible for the sulfonimines known from EP-A 446 982 and EP-A 453 003 and/or bleach-boosting transition metal salts or transition metal complexes to be present in the inventive detergent formulations as what are known as bleach catalysts.

The useful transition metal compounds include, for example, the manganese-, iron-, cobalt-, ruthenium- or molybdenum-salen complexes known from DE-A 195 29 905 and the N-analog compounds thereof known from DE-A 196 20 267, the manganese-, iron-, cobalt-, ruthenium- or molybdenum-carbonyl complexes known from DE-A 195 36 082, the manganese, iron, cobalt, ruthenium, molybdenum, titanium, vanadium and copper complexes which have nitrogen-containing tripod ligands and are described in DE-A 196 05 688, the cobalt-, iron-, copper- and ruthenium-amine complexes known from DE-A 196 20 411, the manganese, copper and cobalt complexes described in DE-A 44 16 438, the cobalt complexes described in EP-A 272 030, the manganese complexes known from EP-A 693 550, the manganese, iron, cobalt and copper complexes known from EP-A 392 592, and/or the manganese complexes described in EP-A 443 651, EP-A 458 397, EP-A 458 398, EP-A 549 271, EP-A 549 272, EP-A 544 490 and EP-A 544 519. Combinations of bleach activators and transition metal bleach catalysts are known, for example, from DE-A 196 13 103 and WO 95/27 775.

Dinuclear manganese complexes which comprise 1,4,7-trimethyl-1,4,7-triazacyclo-nonane (TMTACN), for example $[(TMTACN)_2Mn^{IV}Mn^{IV}(\mu\text{-}O)_3]^{2+}(PF_6^-)_2$ are likewise suitable as effective bleach catalysts. These manganese complexes are likewise described in the aforementioned documents.

Suitable bleach catalysts are preferably bleach-boosting transition metal complexes or salts from the group consisting of the manganese salts and complexes and the cobalt salts and complexes. More preferably suitable are the cobalt(amine) complexes, the cobalt(acetate) complexes, the cobalt(carbonyl) complexes, the chlorides of cobalt or manganese, manganese sulfate or $[(TMTACN)_2Mn^{IV}Mn^{IV}(\mu\text{-}O)_3]^{2+}(PF_6^-)_2$.

Bleach catalysts may be used in amounts of from 0.0001 to 5% by weight, preferably of from 0.0025 to 1% by weight, more preferably of from 0.01 to 0.25% by weight, based on the overall detergent formulation.

As further constituents of the detergent formulation, one or more alkali carriers may be present. Alkali carriers are ammonium and alkali metal hydroxides, ammonium and alkali metal carbonates, ammonium and alkali metal hydrogencarbonates, ammonium and alkali metal sesquicarbonates, ammonium and alkali metal silicates, ammonium and alkali metal metasilicates, ammonium and alkali metal disilicates and mixtures of the aforementioned substances, preference being given to using ammonium and alkali metal carbonates and ammonium and alkali metal disilicates, in particular sodium carbonate, sodium hydrogencarbonate, sodium sesquicarbonate and β- and δ-sodium disilicates $Na_2Si_2O_5\ yH_2O$.

The corrosion inhibitors used may be silver protectants from the group of the triazoles, the benzotriazoles, the bis-benzotriazoles, the aminotriazoles, the alkylaminotriazoles and the transition metal salts or complexes. Particular preference is given to using benzotriazole and alkylaminotriazole. In addition, active chlorine-containing agents which distinctly reduce the corrosion of the silver surface frequently find use in detergent formulations. In chlorine-free detergents, preference is given to using oxygen- and nitrogen-containing organic redox-active compounds such as di- and trihydric phenols, for example hydroquinone, pyrocatechol, hydroxyhydroquinone, gallic acid, phloroglucine, pyrogallol and derivatives of these compound classes. Salt- and complex-type inorganic compounds such as salts of the metals Mn, Ti, Zr, Hf, V, Co and Ce frequently also find use. Preference is given in this context to the transition metal salts which are selected from the group of the manganese and/or cobalt salts and/or complexes, more preferably from the group of the cobalt(amine) complexes, the cobalt(acetate) complexes, the cobalt(carbonyl) complexes, the chlorides of cobalt or manganese, and of magnesium sulfate. It is likewise possible to use zinc compounds or bismuth compounds to prevent corrosion on the ware, especially made of glass.

Paraffin oils and silicone oils may optionally be used as defoamers and to protect plastics and metal surfaces. Defoamers are used generally in proportions of from 0.001% by weight to 5% by weight. In addition, dyes, for example patent blue, preservatives, for example Kathon CG, perfumes and other fragrances may be added to the inventive detergent formulation.

An example of a suitable filler is sodium sulfate.

The present invention also provides mixed powders or mixed granules for use in detergent formulations for machine dishwashing, composed of a) from 30 to 95% by weight of the copolymers as defined above composed of components a1), a2) and, if appropriate, a3) and a4), b) from 5 to 70% by weight of complexing agents selected from the group consisting of nitrilotriacetic acid, ethylenediaminetetraacetic acid, diethylenetriaminepentaacetic acid, hydroxyethylethylenediaminetriacetic acid and glycine-N,N-diacetic acid and their derivatives, glutamic acid N,N-diacetic acid, iminodisuccinate, hydroxyiminodisuccinate, S,S-ethylenediamine-disuccinate and aspartic acid diacetic acid and also the salts of the aforementioned substances, and, if appropriate, c) from 0 to 20% by weight of a polyethylene glycol, of a nonionic surfactant or of a mixture thereof.

As component (c), it is possible with preference to use a polyethylene glycol, more preferably having a mean molecular weight (weight-average molecular weight) of from 500 to 30 000 g/mol.

The polyethylene glycol used as component (c) has preferably OH end groups and/or $C_{1-6}$-alkyl end groups. In the inventive mixture, particular preference is given to using, as component (c), a polyethylene glycol which has OH and/or methyl end groups.

The polyethylene glycol preferably has a molecular weight (weight-average molecular weight) of from 1000 to 5000 g/mol, most preferably from 1200 to 2000 g/mol.

Suitable compounds usable as component (c) are nonionic surfactants. These are preferably selected from the group consisting of alkoxylated, primary alcohols, alkoxylated fatty alcohols, alkylglycosides, alkoxylated fatty acid alkyl esters, amine oxides and polyhydroxy fatty acid amides.

The nonionic surfactants used are preferably alkoxylated, advantageously ethoxylated, especially primary alcohols having preferably from 8 to 18 carbon atoms and an average of from 1 to 12 mol of ethylene oxide (EO) per mole of alcohol, in which the alcohol radical may be linear or preferably 2-methyl-branched, or may comprise linear and branched radicals in a mixture, as are typically present in oxo alcohol radicals. However, preference is given in particular to alcohol ethoxylates with linear radicals from alcohols of native origin with from 12 to 18 carbon atoms, for example from coconut alcohol, palm alcohol, tallow fat alcohol or oleyl alcohol, and an average of from 2 to 8 EO per mole of alcohol. The preferred ethoxylated alcohols include, for example, $C_{12-14}$ alcohols with 3 EO, 4 EO or 7 EO, $C_{9-11}$ alcohols with 7 EO, $C_{13-15}$ alcohols with 3 EO, 5 EO, 7 EO or 8 EO, $C_{12-18}$ alcohols with 3 EO, 5 EO or 7 EO and mixtures thereof, such as mixtures of $C_{12-14}$ alcohol with 3 EO and $C_{12-14}$ alcohol with 7 EO. The degrees of ethoxylation specified are statistical averages which may be a whole or fractional number for a specific product. Preferred alcohol ethoxylates have a narrowed homologous distribution ("narrow range ethoxylates", NRE).

The inventive mixed powders or mixed granules are prepared by mixing components (a), (b) and (c) as a powder, heating the mixture and adjusting the powder properties in the subsequent cooling and shaping process.

It is also possible to granulate components (a) and (b) with the already molten component (c) and subsequently to cool them. The subsequent solidification and shaping are effected in accordance with the known processes of melt finishing, for example by prilling or on cooling belts with, if required, downstream steps for adjusting the powder properties, such as grinding and sieving.

The inventive mixed powders or mixed granules may also be prepared by dissolving components (a), (b) and (c) in a solvent and spray-drying the resulting mixture, which can be followed by a granulating step. In this case, components (a) to (c) may be dissolved separately, in which case the solutions are subsequently mixed, or a powder mixture of the components can be dissolved in water. The solvents used may be all of those which can dissolve components (a), (b) and (c). Preference is given to using, for example, alcohols and/or water, more preferably water.

The invention is illustrated in detail by the examples which follow.

EXAMPLES

Examples 1 to 3 and Comparative Examples C1 to C3

To test the inventive combinations of copolymers and complexing agents, the following formulations were used (table 1):

TABLE 1

| Ingredients | Formulation [% by wt.] |
|---|---|
| Methylglycinediacetic acid Na salt | 22.2 |
| Sodium citrate•2 $H_2O$ | 11.1 |
| Sodium carbonate | 35.6 |
| Sodium hydrogencarbonate | |
| Sodium disilicate ($x$ $Na_2O$•$y$ $SiO_2$; x/y = 2.65; 80%) | 5.6 |
| Sodium percarbonate ($Na_2CO_3$•1.5 $H_2O_2$) | 11.1 |
| Tetraacetylenediamine (TAED) | 3.3 |

TABLE 1-continued

| Ingredients | Formulation [% by wt.] |
|---|---|
| Low-foaming nonionic surfactant based on fatty alcohol alkoxylates | 5.6 |
| Copolymer | 5.6 |

The testing was effected under the test conditions below:

| | |
|---|---|
| Dishwasher: | Miele G 686 SC |
| Wash cycles: | 2 wash cycles, 55° C. Normal (without prewash) |
| Ware: | Knives (WMF Berlin table knives, monobloc) and glass tumblers (Matador from Ruhr Kristall), plastic plates (SAN plates from Kayser); ballast dishware: 6 black dessert plates |
| Rinse temperature: | 65° C. |
| Water hardness: | 25° GH (corresponding to 445 mg of $CaCO_3$/kg) |

In some of the experiments, in each case 50 g of IKW ballast soil, according to SÖFW-Journal, 124, 14/98, p. 1029, were introduced into the dishwasher at the start of the experiment.

The following polymers were used:

Polymer 1: Copolymer of acrylic acid, maleic acid and allyl alcohol, ethoxylated with 16.6 mol of EO/mol of allyl alcohol in a molar ratio of 82.5:15:2.5, K value=74.5, measured at pH 7 in 1% by weight solution at 25° C., Polymer 2: Copolymer of acrylic acid and glycerol monoallyl ether, ethoxylated with 20 mol of EO/mol of glycerol monoallyl ether in a molar ratio of 97.7:2.3, K value=61.7, measured at pH 7 in 1% by weight aqueous solution at 25° C., Polymer 3: Polyacrylic acid with a molecular weight Mw of 8000 g/mol, Polymer 4: Copolymer of acrylic acid and allyl alcohol, ethoxylated with 16.6 mol of EO/mol of allyl alcohol, in a molar ratio of 99.2:0.8, K value=34.3, measured at pH 7 in 1% by weight aqueous solution at 25° C. with a molecular weight Mw of 12 500 g/mol Table 2 lists the test conditions of examples 1 to 3 and of comparative examples C1 to C3:

TABLE 2

| Example | Soil | Polymer |
|---|---|---|
| 1 | Yes | Polymer 1 |
| 2 | Yes | Polymer 2 |
| C1 | Yes | Polymer 3 |
| 3 | No | Polymer 1 |
| C2 | No | Polymer 3 |
| C3 | No | Polymer 4 |

The ware was assessed 18 h after the cleaning by visual grading in a light box which had a black coating, halogen spotlight and perforated plate, using a scale from 10 (very good) to 1 (very poor). The highest mark of 10 corresponds to film- and drip-free surfaces; from marks <3, films and drops are discernible even under normal room lighting and are thus regarded as objectionable.

The results of the wash experiments are compiled in table 3 below.

TABLE 3

| Example | Assessment (mark) | | |
|---|---|---|---|
| | Film on knives | Film on glasses | Film on plastic |
| 1 | 6.0 | 7.5 | 1.4 |
| 2 | 5.8 | 7.0 | 1.4 |
| C1 | 5.6 | 6.7 | 1.4 |
| 3 | 4.4 | 4.4 | 1.7 |
| C2 | 3.5 | 3.4 | 1.7 |
| C3 | 4.1 | 3.8 | 1.7 |

The experiments show that the use of inventive copolymers in combination with selected complexing agents can distinctly reduce film formation, especially on glass and stainless steel.

The invention claimed is:

1. A phosphate-free detergent formulation comprising:

a) from 1 to 20% by weight of at least one copolymer selected from the group consisting of:

an ethoxylated copolymer of acrylic acid, maleic acid and allyl alcohol; and an ethoxylated copolymer of acrylic acid and glycerol monoallyl ether, where the copolymer has a mean molecular weight $M_w$ of from 30 000 to 500 000 g/mol and a K value of from 40 to 150, measured at pH 7 in 1% by weight aqueous solution at 25° C., b) from 1 to 50% by weight of at least one complexing agent selected from the group consisting of nitrilotriacetic acid, ethylenediaminetetraacetic acid, diethylenetriaminepentaacetic acid, hydroxyethylethylenediaminetriacetic acid and glycine-N,N-diacetic acid and their derivatives, glutamic acid N,N-diacetic acid, iminodisuccinate, hydroxyiminodisuccinate, S,S-ethylenediaminedisuccinate and aspartic acid diacetic acid and also the salts of the aforementioned substances, c) from 1 to 15% by weight of a low-foaming nonionic surfactant, d) from 0.1 to 30% by weight of a bleach and, optionally, a bleach activator, e) from 0 to 60% by weight of a further builder, f) from 0 to 8% by weight of an enzyme, and g) from 0 to 50% by weight of one or more further additives, wherein the sum of components a) to g) is 100% by weight.

2. The phosphate-free detergent formulation according to claim 1, wherein the complexing agent b) is methylglycinediacetic acid and/or a salt thereof.

3. A mixed powder or mixed granule comprising:

a) from 30 to 95% by weight of at least one copolymer selected from the group consisting of:

an ethoxylated copolymer of acrylic acid, maleic acid and allyl alcohol; and an ethoxylated copolymer of acrylic acid and glycerol monoallyl ether, where the copolymer has a mean molecular weight $M_w$ of from 30 000 to 500 000 g/mol and a K value of from 40 to 150 , measured at pH 7 in 1% by weight aqueous solution at 25° C., b) from 5 to 70% by weight of at least one complexing agent selected from the group consisting of nitrilotriacetic acid, ethylenediaminetetraacetic acid and glycine-N,N-diacetic acid derivatives, glutamic acid N,N-diacetic acid, iminodisuccinic acid, hydroxyiminodisuccinic acid, S,S-ethylenediaminedisuccinic acid and aspartic acid diacetic acid, and also the salts of the aforementioned acids, c) from 0 to 20% by weight of a polyethylene glycol, of a nonionic surfactant or of a mixture thereof.

4. The phosphate-free detergent formulation according to claim 1, wherein the formulation is in the form of a tablet, powder, gel, capsule, extrudate or solution.

5. The phosphate-free detergent formulation according to claim 1, wherein the further additives are selected from anionic surfactants, zwitterionic surfactants, bleach catalysts, alkali carriers, corrosion inhibitors, defoamers, dyes, fragrances, fillers, organic solvents, water and mixtures thereof.

* * * * *